US007384025B2

(12) United States Patent
Lo

(10) Patent No.: US 7,384,025 B2
(45) Date of Patent: Jun. 10, 2008

(54) SCREW HIDING DEVICE FOR COMBINING LATERAL TUBES WITH UPRIGHT TUBES

(76) Inventor: Chong-Yi Lo, 3500, Valley Meadow Rd., Sherman Oaks, CA (US) 91403

( * ) Notice: Subject to any disclaimer, the term of this patent is extended or adjusted under 35 U.S.C. 154(b) by 140 days.

(21) Appl. No.: 11/251,829

(22) Filed: Oct. 18, 2005

(65) Prior Publication Data

US 2007/0085066 A1 Apr. 19, 2007

(51) Int. Cl.
*E04H 17/00* (2006.01)

(52) U.S. Cl. ..... 256/65.08; 256/65.12; 256/65.13

(58) Field of Classification Search ..... 256/21, 256/22, 69, 70, 65.02, 65.08, 65.11, 65.12, 256/65.13
See application file for complete search history.

(56) References Cited

U.S. PATENT DOCUMENTS 3,033,532 A * 5/1962 McFall ..... 256/21
3,258,251 A * 6/1966 Culter ..... 256/22
3,414,236 A * 12/1968 Siegal ..... 256/22
5,557,893 A * 9/1996 Bowls ..... 256/64
5,649,688 A * 7/1997 Baker ..... 256/21
6,752,385 B2 * 6/2004 Zen et al. ..... 256/22

* cited by examiner

*Primary Examiner*—Aaron Dunwoody
*Assistant Examiner*—Victor MacArthur
(74) *Attorney, Agent, or Firm*—Bacon & Thomas, PLLC

(57) ABSTRACT

A screw hiding device for combining lateral tubes with upright tubes includes a position strip to match with each lateral tube. Each position strip has an upright wall to contact with each upright tube and fixed together with a screw. Each lateral tube has an upper wall and two side walls forming a lengthwise opening therebetween. Each of the two sides has a lower support ridge and an upper stopper on an inner wall, with the distance between each upper stopper and each lower support ridge being equal to the height of the upright wall of the position strip. Each position strip is fixed on an outer surface of each upright tube with a screw and in the space between the upper stopper and the lower support ridge, with each lateral tube hiding each screw and each position strip to beautify a fence formed by the lateral and the upright tubes.

1 Claim, 9 Drawing Sheets

SCREW HIDING DEVICE FOR COMBINING LATERAL TUBES WITH UPRIGHT TUBES

BACKGROUND OF THE INVENTION

1. Field of the Invention

This invention relates to a screw hiding device for combining lateral tubes with upright tubes, particularly to one for combing lateral tubes with upright tubes used for forming a metal fence or a metal railing. Therefore, the finished fence or railing may have a beautiful appearance, as screws used for combining lateral tubes with upright tubes are hidden, not exposed out of them and accordingly not impairing its decent beautiful outer look.

2. Description of the Prior Art

Most conventional metal fences or railings are composed of plural lateral tubes and plural upright tubes crossingly combined together with screws for tightly combining them, as shown in FIGS. 1 and 2. It can be seen that the fence 1 is made up of plural lateral tubes 10 and plural upright tubes 11 crossing with one another, and the crossing point of each lateral tube 10 with each upright tube 11 is tightly secured with a screw 12 screwing through the both. As shown in FIGS. 2A, 2B, and 2C, the screws are used at every crossing points of the lateral and the upright tubes 10 and 11 for forming a complete fence 1. However, it is very evident that the screws 12 have their heads exposed and protruding out on the surface of each lateral tube 10, as shown in FIGS. 1, 2A, 2B and 2C, making up drawbacks to reduce beauty and decency of the fence 1.

SUMMARY OF THE INVENTION

This invention has been devised to offer a screw hiding device for combining lateral tubes with upright tubes, not letting screws exposed out of the lateral tubes, keeping a beautiful outer look of a fence, The feature of the invention is a position strip to be fixed on each upright tube with a screw at first and then each lateral tube is provided with a plurality of holes in an upper side and a lower side for the upright tubes to pass through except the uppermost lateral tube having holes fir the upright tubes only in the lower side. Each lateral tube further has a lower support ridge at two sides of each opening, and an upper stopper formed to extend inward horizontally on two inner walls above each lower support ridge. When each lateral tube is combined with each upright tube, the position strip is just put in the space between the upper stopper and the lower support ridge to combine stably with the upright tube, hiding the screw and the position strip unseen from the outer side, beautifying a fence formed with the lateral tubes and the, upright tubes.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
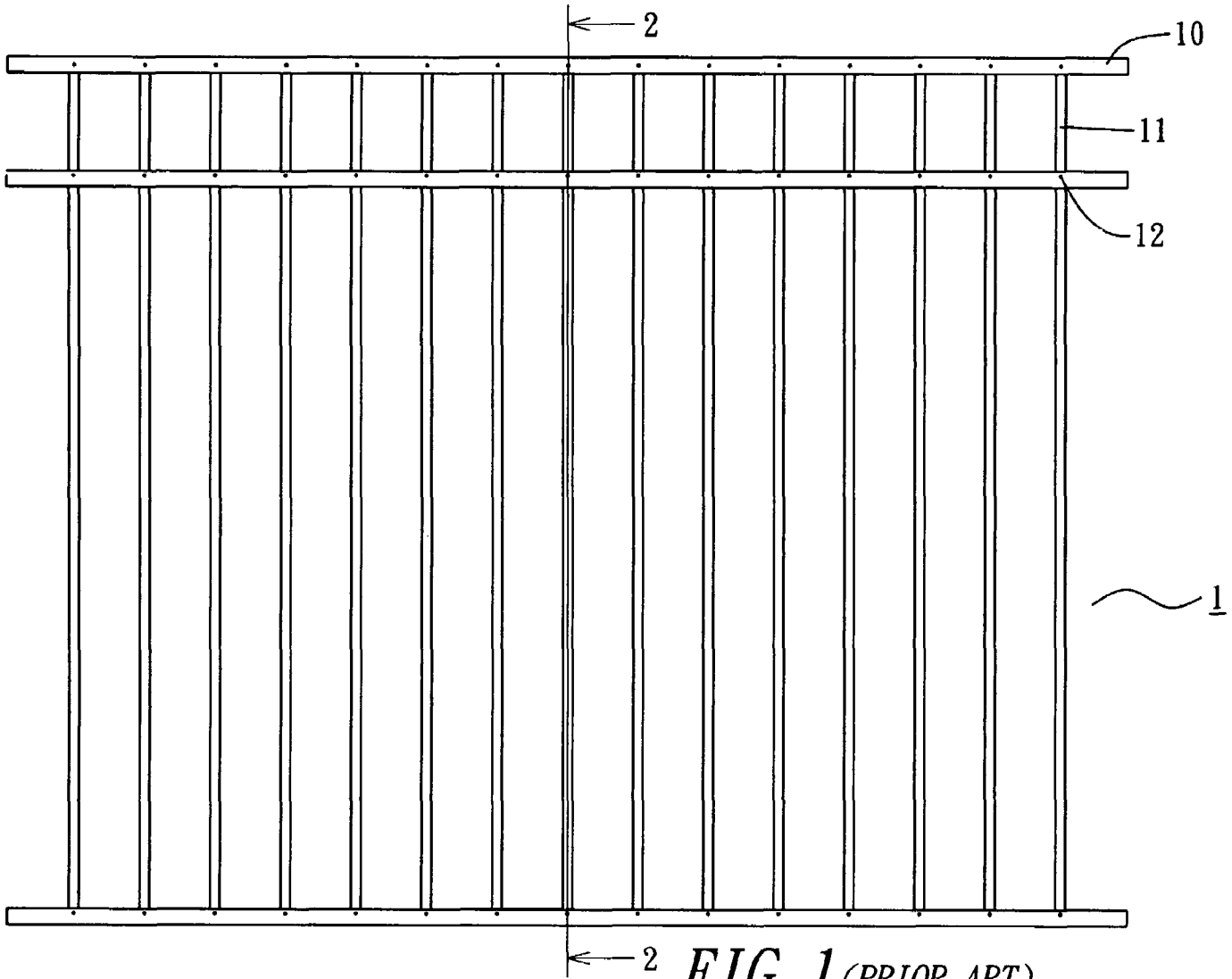
FIG. 1 (PRIOR ART)
FIG. 1 is a front view of a conventional metal fence.
Figure 2:
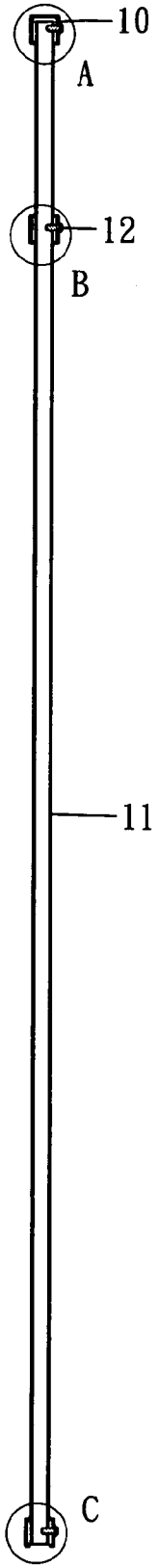
FIG. 2 (PRIOR ART)
FIG. 2 is a cross-sectional view of the line 2-2 in FIG. 1.
Figure 2A:
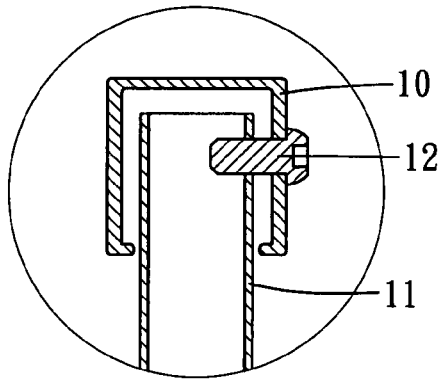
FIG. 2A (PRIOR ART)
FIG. 2A is a partial magnified view of the part marked (A) in FIG. 2.
Figure 2B:
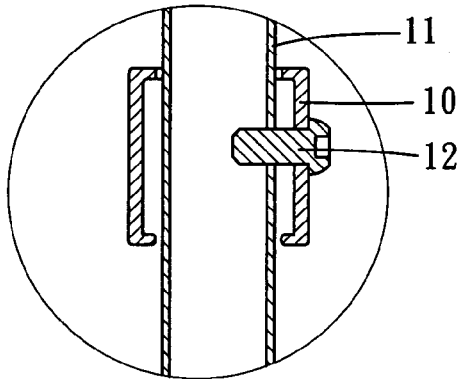
FIG. 2B (PRIOR ART)
FIG. 2B is a partial magnified view of the part marked (B) in FIG. 2.
Figure 2C:
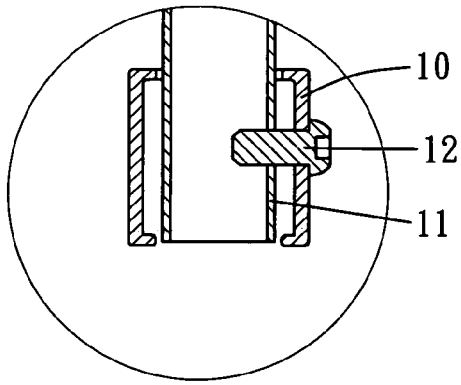
FIG. 2C (PRIOR ART)
FIG. 2C is a partial magnified view of the part marked (C) in FIG. 2.
Figure 3:
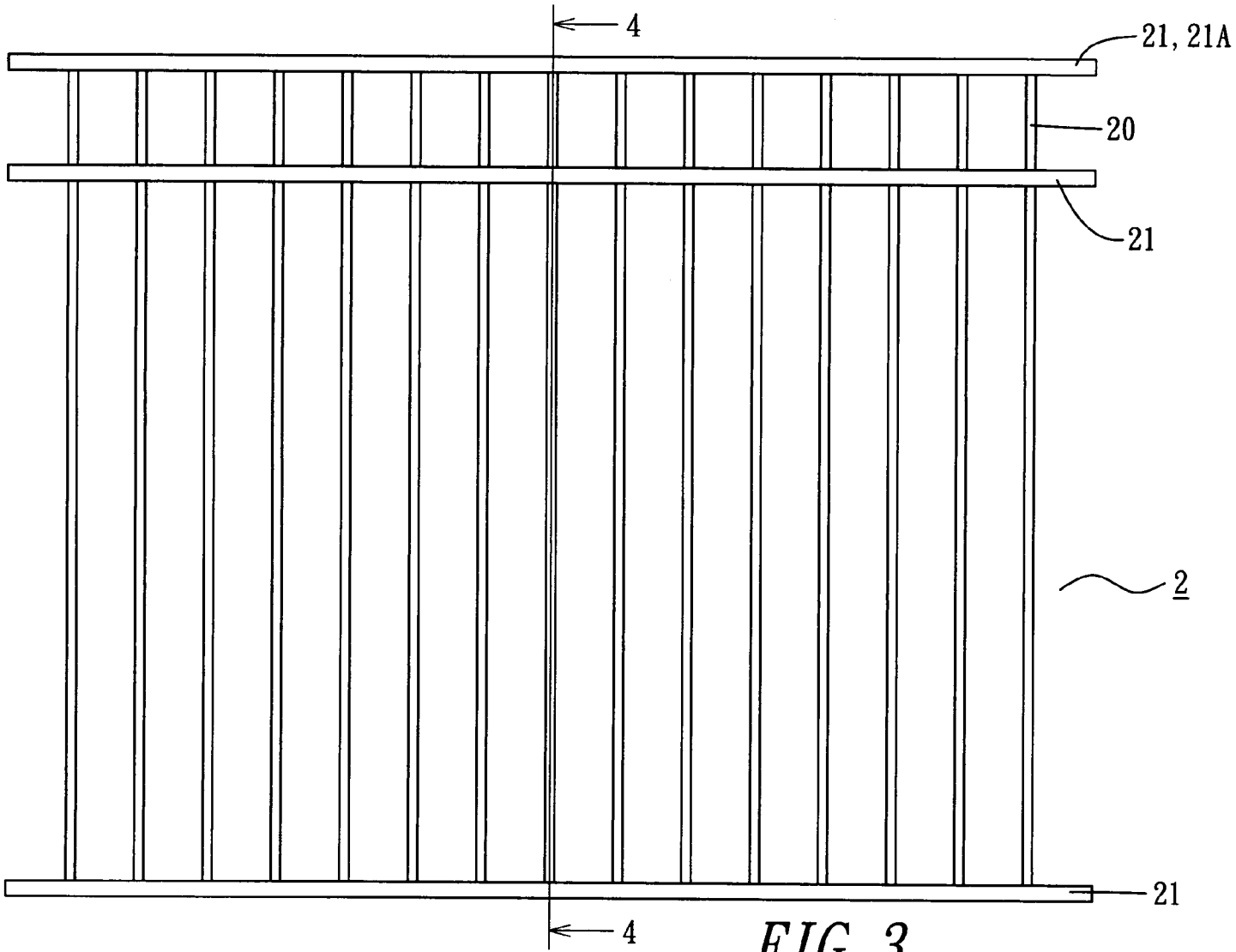
FIG. 3 is a front view of a first embodiment of a metal fence having a screw hiding device in the present invention.
Figure 4:
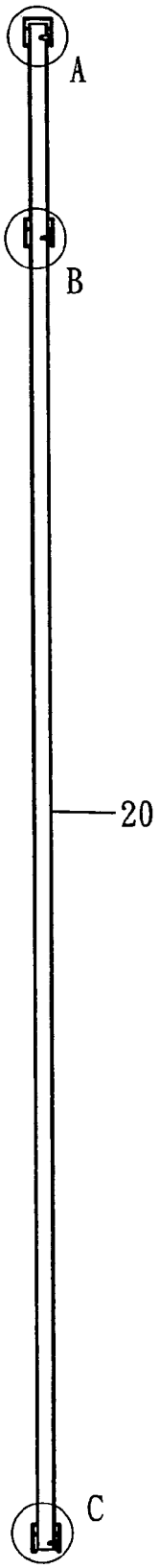
FIG. 4 is a cross-sectional view of the line 4-4 in FIG. 3.
Figure 4A:
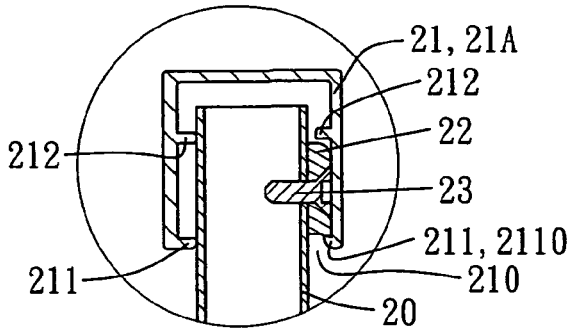
FIG. 4A is a partial magnified view of the part marked (A) in FIG. 4.
Figure 4B:
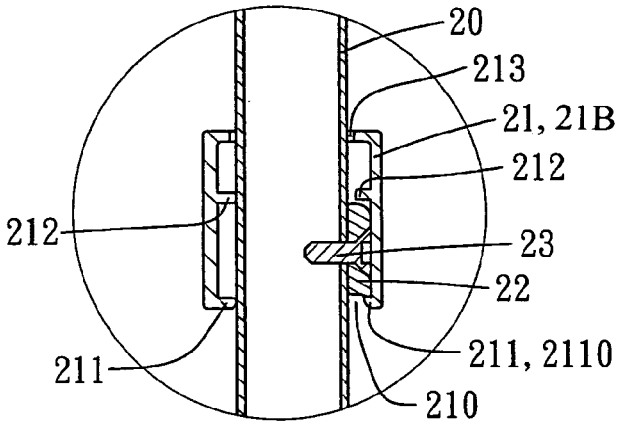
FIG. 4B is a partial magnified view of the part marked (B) in FIG. 4.
Figure 4C:
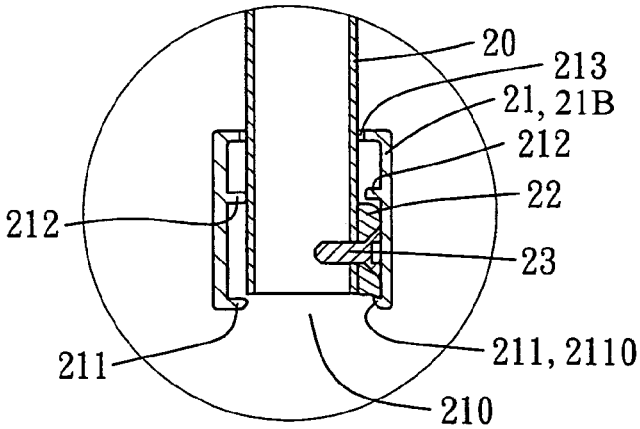
FIG. 4C is a partial magnified view of the part marked (C) in FIG. 4.
Figure 5:
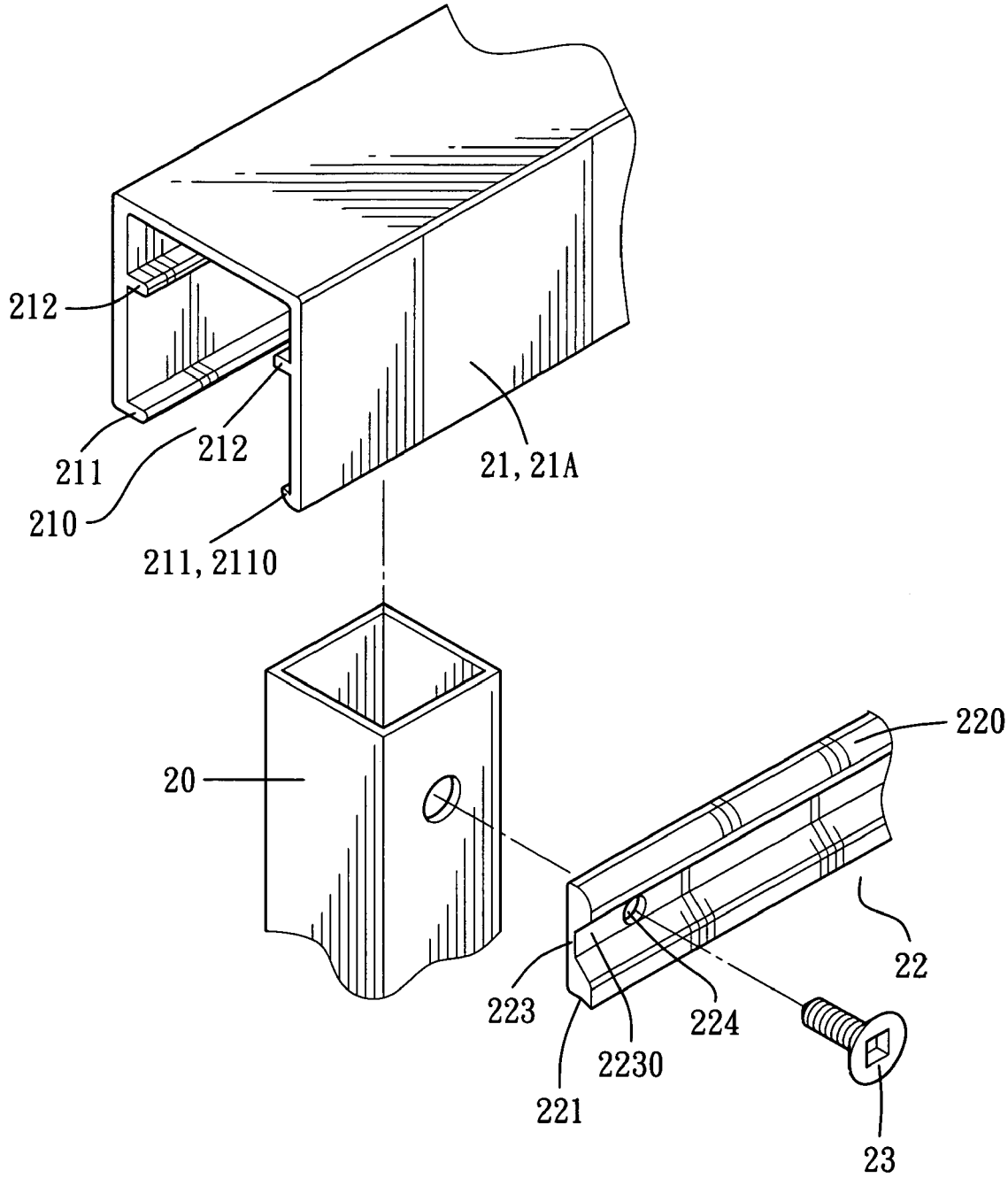
FIG. 5 is a partial exploded perspective view of the first embodiment of the screw hiding device in the present invention.
Figure 6A:
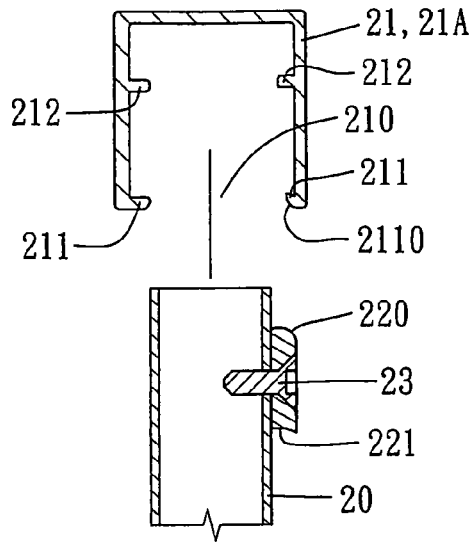
FIGS. 6A-6C are a cross-section view of the first embodiment of a screw hiding device, showing orderly installing process of a lateral tube with an upright tube in the present invention.
Figure 6B:
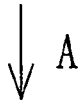
Figure 6B:
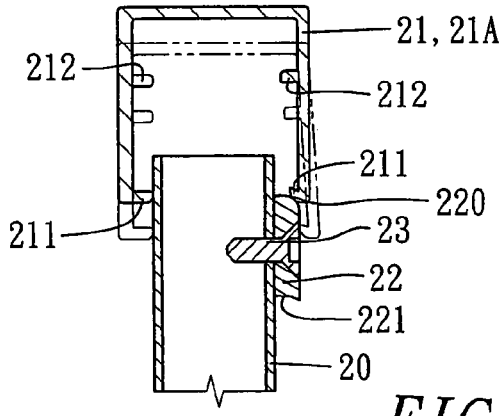
Figure 6C:
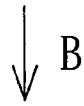
Figure 6C:
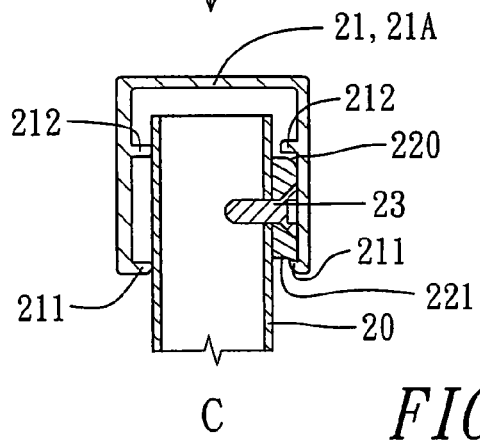

A first embodiment of a screw hiding device for combining lateral tubes with upright tubes is used in a metal fence, as shown in FIGS. 3 and 4, for combining a plurality of upright tubes 20 with a plurality of lateral tubes 21 together. Each lateral tube 21 is provided with a top or upper wall, and two side walls forming a lengthwise opening therebetween. An uppermost lateral tube 21A has a solid top, while lower lateral tubes 21B have plural openings 213 formed in the upper wall as shown in FIGS. 4A, 4B and 4C. A lower support ridge 211 formed respectively at two sides of each opening 210 and extending horizontally inward and having a convex surface 2110 in a lower section. The lateral tubes 21 further have an upper stopper 212 respectively on the two opposite inner walls just above the two lower support ridges 211.

The screw hiding device includes a position strip 22, as shown in FIGS. 4A, 4B, 4C and 5, deposited in each lateral tube 21, having an upright wall 223 to closely contact with an outer surface of an upright tube 20 and fixed tightly with the upright tube 20 with a screw 23 at first, and then each lateral tube 21 is inserted one by one down through the upright tubes 20 and stopped at the outer side of each position strip 22 fixed with each upright tubes 20, hiding each position strip 22 and each relative screw 23, which are not seen from the outer side. The upright wall 223 of each position strip 22 has a flat surface to contact with the outer surface of each upright tube 20, a lengthwise recess 2230 in an intermediate portion of its outer side opposite to the flat surface so that the screw 23 may have its head completely located within and not protruding out of the lengthwise recess 2230 after screwing tightly in a hole 224 bored in the lengthwise recess 2230 in combining each position strip 22 with each upright tube 20, as shown in FIG. 6.

The position strip 22 is used for mainly positioning the lateral tube 21 and also combining each lateral tube 21 with each upright tube 20 at the same time, further having a convex surface 220 in an upper outer end as shown in FIG.

5 and a recessed lower surface 221, with the height of the upright wall 223 equal to the distance (or space) between the upper stopper 212 and the lower support ridges 211. So in combining each lateral tube 21 with each upright tube with the position strip 22, as shown in FIG. 6, the lateral tubes 21 are pressed down one by one from above through the upright tube 20, letting the convex surface 2110 of each lower support ridge 211 slide down over the convex surface 220 of the position strip 22 and down along the outer surface of the position strip 22, passing over the head of each screw 23 until the lower recess 221 of the position strip 22 stops the lower support ridge 211. Then the lateral tube 21 may be positioned immovable upward or downward, with the position strip 22 restricted in the space between the lower support ridge 211 and the upper stopper 212. The upper stopper 212 and the lower support ridge 211 of the lateral tube not facing the position strip have a length equal to the thickness of the position strip 22, so the end tips of the both 212 and 211 contact the outer surface of each upright tube 20 to keep each lateral tube 21 stable not to shift laterally after each lateral tube 21 is properly position in place. Therefore, the lateral tubes 21 can be combined crossing with the upright tubes 20 one another, with the position strips 23 and the screws 23 kept hidden to beautify the appearance of the fence 2 after finished.

Figure 7:
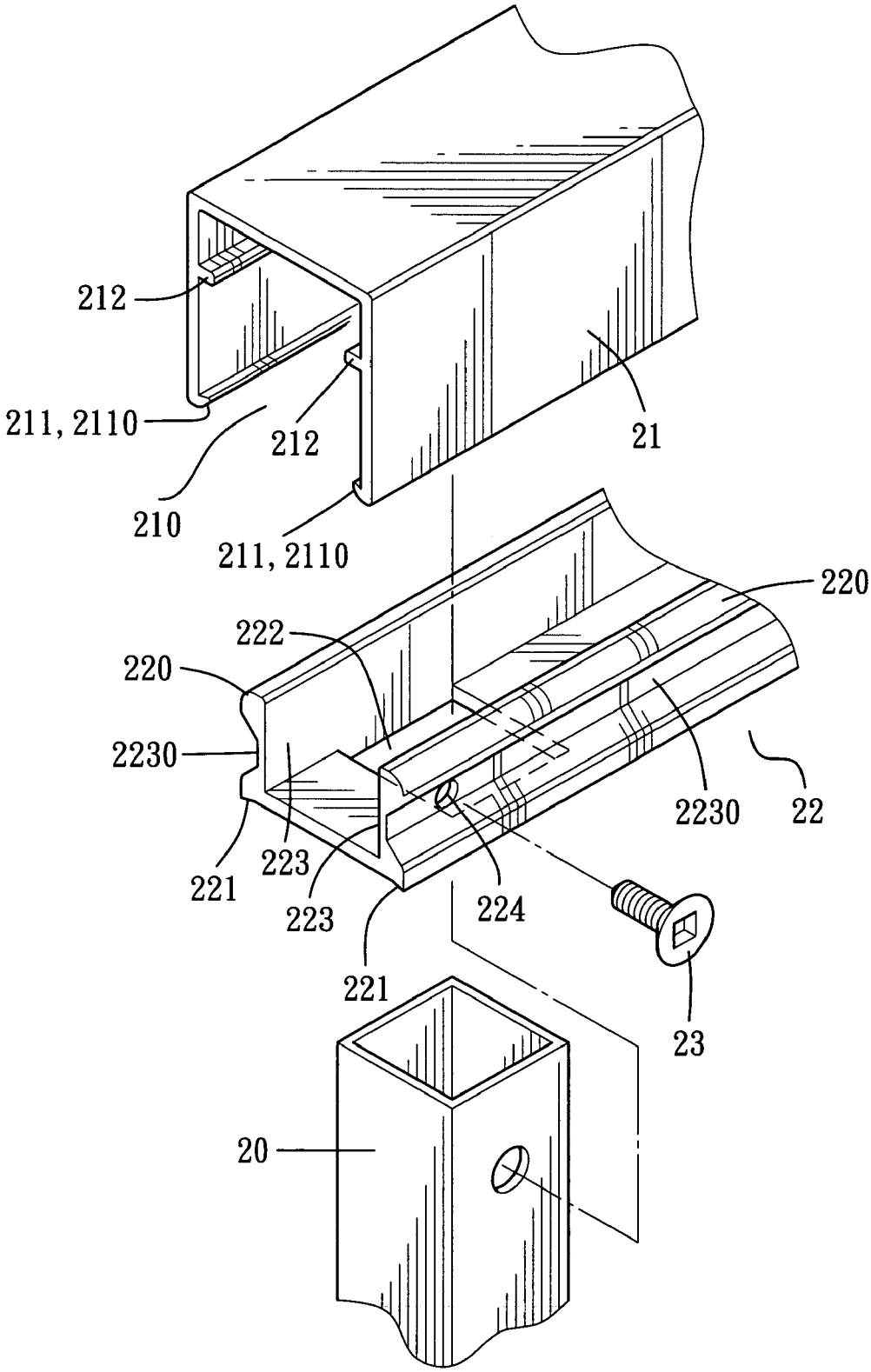
FIG. 7 is a partial exploded perspective view of a second embodiment of a screw hiding device in the present invention.
Figure 8:
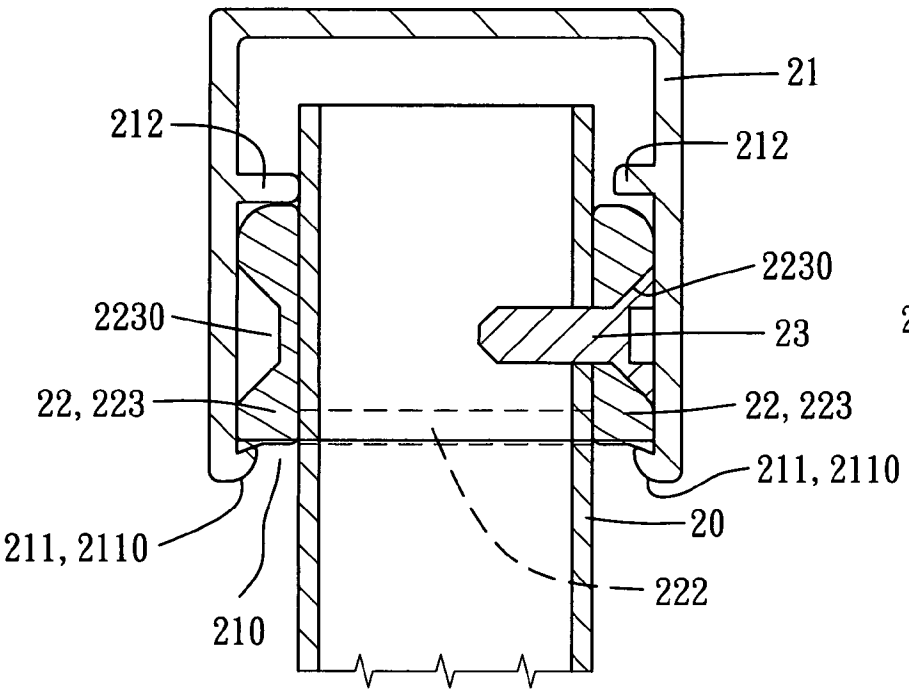
FIG. 8 is a partial cross-sectional view of the second embodiment of a screw hiding device in the present invention.

Next, FIGS. 7 and 8 show a second embodiment of a screw hiding device for combining lateral tubes with upright tubes in the present invention, which has the differences from the first one to be described as follows. The second embodiment includes a position strip 22 shaped as U and having two parallel upright walls 223 respectively at two sides for contacting with two opposite outer surfaces of each upright tube 20, and a plurality of tube holes 222 in the horizontal wall for the upright tubes 20 to pass through. One of the upright walls 223 has a screw hole 224 corresponding to each tube hole 222 for a screw 23 to pass through to screw with each upright tube 20 tightly to fix the position strip 23 with the upright tube 20. Further, the two upright walls 223 have a convex surface 220 at an upper edge and a recessed surface 221 on a lower end section. Each lateral tube 21 has a lengthwise opening 210 in a lower side, and two lower support ridges 211 formed to extend inward horizontally and respectively from the two sides of the lengthwise opening 210, and each lower support ridge 211 has a convex surface 2110 in the lower end. Each lateral tube 21 further has an upper stopper 212 respectively on two inner walls just above the lower support ridge 211, and the distance (or space) between the upper stopper 212 and the lower support ridge 211 is equal to the height of the two upright walls 223. Therefore, each upright tube 20 pass through each opening 222 of each position strip 23 and is fixed stably with the position strip 22 with a screw 23 passing through each screw hole 224 of each position strips 23. Then the lateral tubes 21 are kept pressed down through the upright tubes 20 to contact respectively with each position strip 22, with the space between the upper stopper 212 and the lower support ridge 211 fitting the two upright walls 223. Thus the lateral tubes 21 are positioned stably in place, with the position strips 22 and the screws 23 hidden as shown in FIG. 8, just as those in the first embodiment are.

Figure 10:
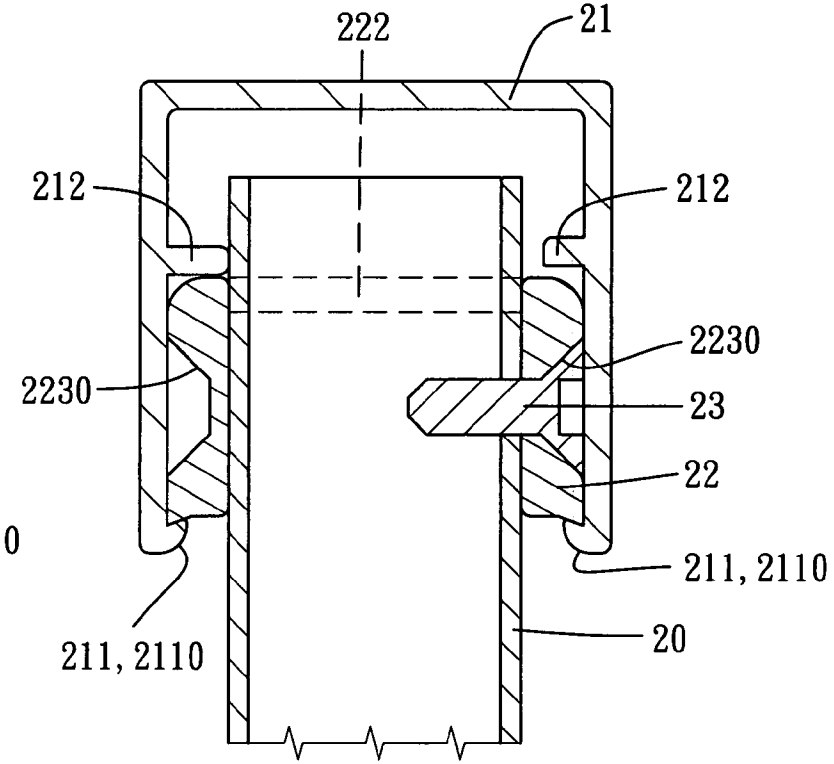
Figure 9:
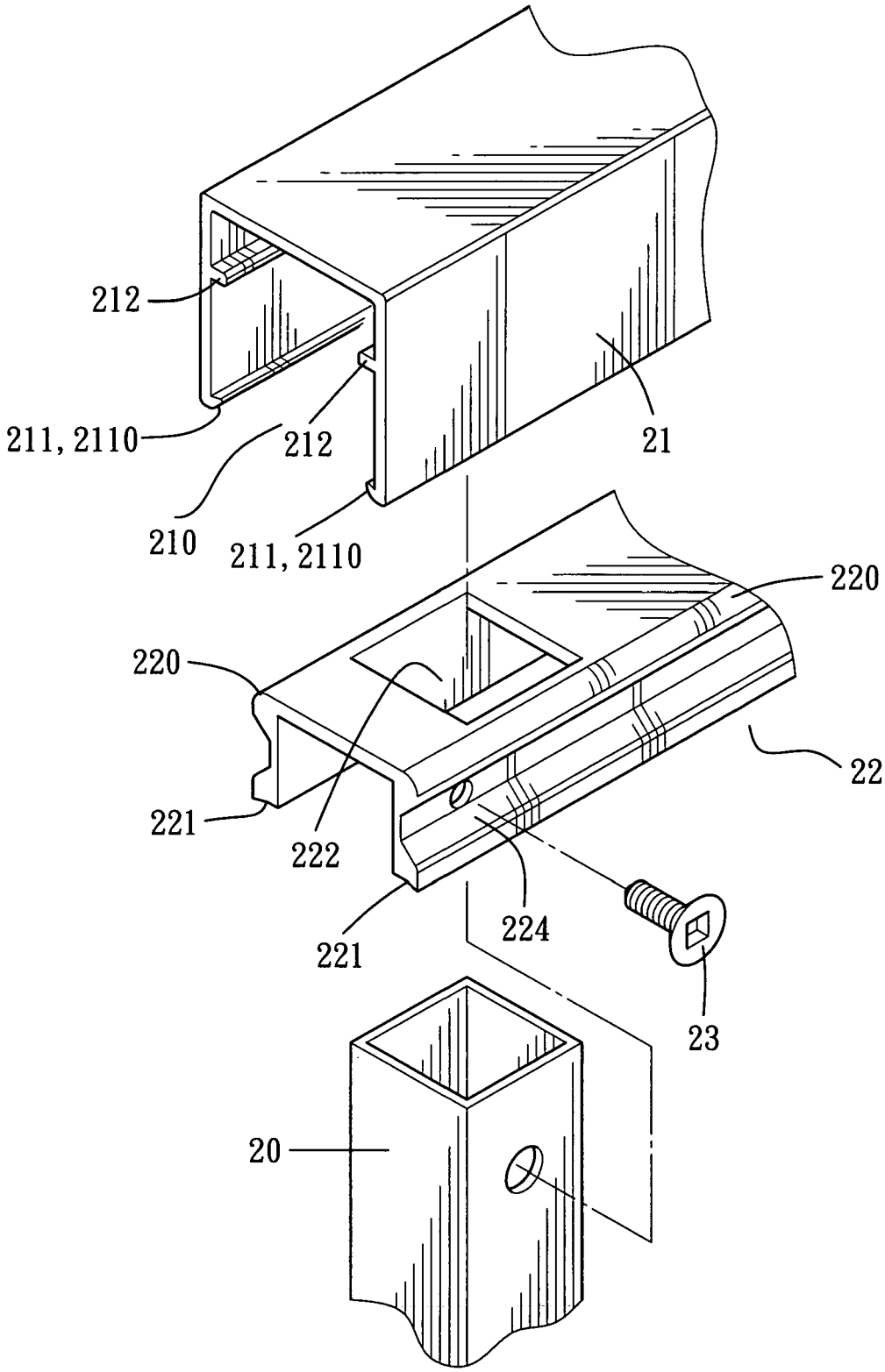
FIG. 9 is a partial exploded perspective view of a third embodiment of a screw hiding device in the present invention; and, FIG. 10 is a partial cross-sectional view of the third embodiment of a screw hiding device in the present invention.

Next, a third embodiment of a screw hiding device is shown in FIGS. 9 and 10, having the difference from the second embodiment in the position strip 23 shaped as an inverted U, just as that in the second embodiment inverted. So the third embodiment can also hide the position strips 22 and the screws 23 as the other two embodiments do, as shown in FIG. 10.

While the preferred embodiments have been described above, it will be recognized and understood that various modifications may be made therein and the appended claims are intended to cover all such modifications that may fall within the spirit and scope of the invention.

What is claimed is:

1. A screw hiding device, comprising:

an uppermost u-shaped lateral tube having a solid top and two sides forming a lengthwise opening therebetween;

a plurality of lower u-shaped lateral tubes each having a top with a plurality of openings and two sides forming a lengthwise opening therebetween;

two lower support ridges extending inwardly and horizontally from two opposite sides of said lengthwise opening, wherein each said lower support ridge has a convex surface;

two upper stoppers extending inwardly and horizontally from two opposite inner walls of said two sides just above each said lower support ridge;

a plurality of upright tubes passing through said lengthwise opening and said plurality of openings in said lateral tubes;

an elongate, plate-shaped position strip connecting each said lateral tube, said position strip comprising:

an upright wall, wherein a back side of said upright wall is located flush against said plurality of upright tubes and a front side of said upright wall is located in an area between said lower support ridge and said upper stopper of each said lateral tube, a height of said upright wall being equal to a distance between each said lower support ridge and each said upper stopper and a thickness of said upright wall being equal to a distance at which said lower support ridge and said upper stopper extend inwardly and horizontally from said openings and said inner walls, respectively such that at least one end tip of said upper stopper or said lower support ridge contacts an outer surface of each of said upright tubes; and wherein an upper surface of said front side of said upright wall has a convex surface and a lower surface of said front side of said upright wall has a recessed surface; and wherein an intermediate portion of said front side of said upright wall has a lengthwise recess; and a plurality of screws, wherein said screws pass through said elongate, plate-shaped position strip and said upright tubes to secure said position strip to said upright tubes.

* * * * *